US006536464B1

(12) United States Patent
Lum et al.

(10) Patent No.: US 6,536,464 B1
(45) Date of Patent: Mar. 25, 2003

(54) THERMOSTATICALLY CONTROLLED BYPASS VALVE AND WATER CIRCULATING SYSTEM FOR SAME

(75) Inventors: Ken Lum; Dale Kempf; Keith Harris, all of Fresno, CA (US)

(73) Assignee: Grundfos Pumps Manufacturing Corporation, Fresno, CA (US)

( * ) Notice: Subject to any disclaimer, the term of this patent is extended or adjusted under 35 U.S.C. 154(b) by 118 days.

(21) Appl. No.: 09/697,520

(22) Filed: Oct. 25, 2000

(51) Int. Cl.[7] ..... F16K 49/00

(52) U.S. Cl. ..... 137/337; 236/12.11; 122/13.3; 4/638; 417/32

(58) Field of Search ..... 137/334, 337; 417/32; 236/12.11; 122/13.3; 4/638

(56) References Cited

U.S. PATENT DOCUMENTS

| | | | | | |
|---|---|---|---|---|---|
| 2,716,424 | A | | 8/1955 | Watts | |
| 2,823,695 | A | | 2/1958 | Coffin | |
| 2,842,155 | A | | 7/1958 | Peters | |
| 3,741,195 | A | * | 6/1973 | Ellis | 126/362 |
| 4,142,515 | A | * | 3/1979 | Skaats | 417/12 |
| 4,321,943 | A | * | 3/1982 | Haws | 137/337 |
| 4,331,292 | A | | 5/1982 | Zimmer | |
| 4,606,325 | A | * | 8/1986 | Lujan, Jr. | 126/362 |
| 5,119,988 | A | | 6/1992 | Fiedrich | |
| 5,135,021 | A | | 8/1992 | Pegg | |
| 5,183,029 | A | | 2/1993 | Ranger | |
| 5,209,401 | A | | 5/1993 | Fiedrich | |
| 5,261,443 | A | * | 11/1993 | Walsh | 137/337 |
| 5,287,570 | A | | 2/1994 | Peterson et al. | |
| 5,323,803 | A | | 6/1994 | Blumenauer | |
| 5,572,985 | A | | 11/1996 | Benham | |
| 5,623,990 | A | | 4/1997 | Pirkle | |
| 5,829,467 | A | * | 11/1998 | Spicher | 137/14 |

OTHER PUBLICATIONS

Unknown, "Why Wait for Hot Water?, " 1998, total 4 pages including Order Form, The Blumenauer Corporation, published on Internet (printed Apr. 19, 2001).

Unknown, "AquaLink–How it Works", 1998, total 2 pages, The Blumenauer Corporation, published on Internet (printed Apr. 19, 2001).

(List continued on next page.)

*Primary Examiner*—A. Michael Chambers
(74) *Attorney, Agent, or Firm*—Richard A. Ryan

(57) ABSTRACT

A thermostatically controlled bypass valve for bypassing water away from a hot water valve until the water temperature reaches a desired level at a fixture in use for home or industrial applications. The bypass valve has a valve body with a thermally sensitive actuator disposed between the hot water inlet and discharge ports and the cold water inlet and discharge ports that is thermally responsive to the temperature of the water. A bias spring pushes against the piston on the thermal actuator to close the actuator and open a passage between the cold and hot water sides when water needs to be bypassed. When the water from the hot water heater reaches the desired temperature level at the bypass valve, the bypass valve closes and hot water is made available to the hot water side of the fixture. Until then, the thermal actuator remains open and cold or tepid water is allowed to bypass the hot water side of the fixture. Flexible hoses attach the inlet and discharge ports on the hot and cold water sides to the hot and cold water supply systems and the hot and cold water valves on the fixture. A check valve can be placed on the cold water side to prevent the flow of cold water through the bypass valve when only the hot water side is flowing. The bypass valve can used as part of a water circulating system having a pump placed in the hot water piping system that can also include a pump check valve for bypassing high flows around the pump and a flow rate switch for turning off the pump. The bypass valve can be incorporate integrally into the fixture.

48 Claims, 4 Drawing Sheets

OTHER PUBLICATIONS

Unknown, Aqua–Heat Hot Water Recirculating System–Installation and Operation Instructions, unknown, total 4 pages, The Blumenauer Corporation.
Unknown, "Laing Autocirc", unknown, total 1 page (2 sides), Laing Thermotech, Inc.
Unknown, "Laing Autocir" 2001, total 3 pages, Laing Thermotech, Inc.
Unknown, "Laing Instant Hot Water Delivery Systems", 2001, total 3 pages, Laing Thermotech, Inc.
Unknown, "Metlund–Installation and Operating Instructions", Dec. 2000, total 6 pages, Advanced Conservation Technology, Inc.
Unknown, "Metlund Systems", 1999, total 1 page, Advanced Conservation Technology, Inc.
Unknown, "Metlund D'Mand Systems", unknown, total 1 page (2 sides), Advanced Conservation Technology, Inc.
Dulley, Jim, "Update Bulletin No. 991", 2001, total 4 pages, Cincinnati, Ohio.
Unknown, "Metlund Systems", unknown (printed from Internet on Apr. 19, 2001), total 16 pages, Advanced Conservation Technology, Inc.
Unknown, "Metlund Systems", unknown (printed from Internet on Apr. 19, 2001), collection of Intenet pages–total of 9 pages, Advanced Conservation Technology, Inc.
Unknown, "Metlund Electronic Technology", unknown (printed from Internet on Apr. 19, 2001), 11 pages, Advanced Conservation Technology, Inc.
Unknown, "Metlund Systems–Online Ordering", unknown (printed from Internet on Apr. 10, 2001), 2 pages, Advanced Conservation Technology, Inc.
Unknown, "Grundfos Hot Water Recirculation–Product and Appication Guide", Mar. 2001, 10 pages, Grundfos Pumps Corporation.
Unknown, "NIBCO–Ahead of the Flow–Just Right", unknown (printed from Internet on Apr. 19, 2001, 10 pages (collection of Intenet material), NIBCO, Inc.
Unknown, "The Chilipepper How Water Appliance", unknown (printed from Internet on Apr. 19, 2001, 22 pages (collection of Internet materials), Central Plastics.
Unknown, "Installation and Operating Instructions for the Chilipepper Appliance", unknown, 2 pages, Central Plastics.

* cited by examiner

THERMOSTATICALLY CONTROLLED BYPASS VALVE AND WATER CIRCULATING SYSTEM FOR SAME

BACKGROUND OF THE INVENTION

1. Field of the Invention

The present invention relates generally to bypass valves for use in home or industrial water distribution systems that supply water to various fixtures at different temperatures through different pipes. More particularly, the present invention relates to such bypass valves that are thermostatically controlled so as to automatically bypass water that is not at the desired temperature for use at the fixture. Even more particular, the present invention relates to use of such a thermostatically controlled bypass valve in a water distribution system utilizing a single circulating pump at the water heater.

2. Background

Home and industrial water distribution systems distribute water to various fixtures, including sinks, bathtubs, showers, dishwashers and washing machines, that are located throughout the house or industrial building. The typical water distribution system brings water in from an external source, such as a city main water line or a private water well, to the internal water distribution piping system. The water from the external source is typically either at a cold or cool temperature. One segment of the piping system takes this incoming cold water and distributes it to the various cold water connections located at the fixture where it will be used (i.e., the cold water side of the faucet at the kitchen sink). Another segment of the piping system delivers the incoming cold water to a water heater which heats the water to the desired temperature and distributes it to the various hot water connections where it will be used (i.e., the hot water side of the kitchen faucet). At the fixture, cold and hot water either flows through separate hot and cold water control valves that are independently operated to control the temperature of the water into the fixture by controlling the flow rate of water from the valves or the water is mixed at a single valve that selectively controls the desired temperature flowing into the fixture.

A well known problem common to most home and industrial water distribution systems is that hot water is not always readily available at the hot water side of the fixture when it is desired. This problem is particularly acute in water use fixtures that are located a distance from the hot water heater or in systems with poorly insulated pipes. When the hot water side of these fixtures is left closed for some time (i.e., overnight), the hot water in the hot water segment of the piping system sits in the pipes and cools. As a result, the temperature of the water between the hot water heater and the fixture lowers until it becomes cold or at least tepid. When opened again, it is not at all uncommon for the hot water side of such a fixture to supply cold water through the hot water valve when it is first opened and for some time thereafter. At the sink, bathtub or shower fixture located away from the water heater, the person desiring to use the fixture will either have to use cold or tepid water instead of hot water or wait for the distribution system to supply hot water through the open hot water valve. Most users have learned that to obtain the desired hot water, the hot water valve must be opened and left open for some time so that the cool water in the hot water side of the piping system will flow out ahead of the hot water. For certain fixtures, such as dishwashers and washing machines, there typically is no method of "draining" away the cold or tepid water in the hot water pipes prior to utilizing the water in the fixture.

The inability to have hot water at the hot water side of the fixture when it is desired creates a number of problems. One problem is having to utilize cold or tepid water when hot water is desired. This is a particular problem for the dishwasher and washing machine fixtures in that hot water is often desired for improved operation of those fixtures. As is well known, certain dirty dishes and clothes are much easier to clean in hot water as opposed to cold or tepid water. Even in those fixtures where the person can let the cold or tepid water flow out of the fixture until it reaches the desired warm or hot temperature, there are certain problems associated with such a solution. One such problem is the waste of water that flows out of the fixture through the drain and, typically, to the sewage system. This good and clean water is wasted. This waste of water is compounded when the person is inattentitive and hot water begins flowing down the drain and to the sewage system. Yet another problem associated with the inability to have hot water at the hot water valve when needed is the waste of time for the person who must wait for the water to reach the desired temperature.

The use of bypass valves and/or water recirculation systems in home or industrial water distribution systems to overcome the problems described above have been known for some time. The objective of the bypass valve or recirculation system is to avoid suppling cold or tepid water at the hot water side of the piping system. U.S. Pat. No. 2,842,155 to Peters describes a thermostatically controlled water bypass valve, shown as FIG. 2 therein, that connects at or near the fixture located away from the water heater. In his patent, the inventor discusses the lack of hot water problem and describes a number of prior art attempts to solve the problem. The bypass valve in this patent comprises a cylindrical housing having threaded ends that connect to the hot and cold water piping at the fixture so as to interconnect these piping segments. Inside the housing at the hot water side is a temperature responsive element having a valve ball at one end that can sealably abut a valve seat. The temperature responsive element is a metallic bellows that extends when it is heated to close the valve ball against the valve seat and contracts when cooled to allow water to flow from the hot side to the cold side of the piping system when both the hot and cold water valves are closed. Inside the housing at the cold water side is a dual action check valve that prevents cold water from flowing to the hot water side of the piping system when the hot water valve or the cold water valve is open. An alternative embodiment of the Peters' invention shows the use of a spiral temperature responsive element having a finger portion that moves left or right to close or open the valve between the hot and cold water piping segments. Although the invention described in the Peters' patent relies on gravity or convection flow, similar systems utilizing pumps to cause a positive circulation are increasingly known. These pumps are typically placed in the hot water line in close proximity to the faucet where "instant" hot water is desired.

U.S. Pat. No. 5,623,990 to Pirkle describes a temperature-controlled water delivery system for use with showers and eye-wash apparatuses that utilize a pair of temperature responsive valves, shown as FIGS. 2 and 5 therein. These valves utilize thermally responsive wax actuators that push valve elements against springs to open or close the valves to allow fluid of certain temperatures to pass. U.S. Pat. No. 5,209,401 to Fiedrich describes a diverting valve for hydronic heating systems, best shown in FIGS. 3 through 5, that is used in conjunction with a thermostatic control head having a sensor bulb to detect the temperature of the supply water. U.S. Pat. No. 5,119,988 also to Fiedrich describes a three-way modulating diverting valve, shown as FIG. 6. A non-electric, thermostatic, automatic controller provides the force for the modulation of the valve stem against the spring. U.S. Pat. No. 5,287,570 to Peterson et al. discloses the use of a bypass valve located below a sink to divert cold water from the hot water faucet to the sewer or a water reservoir. As discussed with regard to FIG. 5, the bypass valve is used in conjunction with a separate temperature sensor.

A recirculating system for domestic and industrial hot water heating utilizing a bypass valve is disclosed in U.S. Pat. No. 5,572,985 to Benham. This system utilizes a circulating pump in the return line to the water heater and a temperature responsive or thermostatically actuated bypass valve disposed between the circulating pump and the hot water heater to maintain a return flow temperature at a level below that at the outlet from the water heater. The bypass valve, shown in FIG. 2, utilizes a thermostatic actuator that extends or retracts its stem portion, having a valve member at its end, to seat or unseat the valve. When the fluid temperature reaches the desired level, the valve is unseated so that fluid that normally circulates through the return line of the system is bypassed through the circulating pump.

Despite the devices and systems set forth above, many people still have problems with obtaining hot water at the hot water side of fixtures located away from the hot water heater or other source of hot water. Boosted, thermally actuated valve systems having valves that are directly operated by a thermal actuator (such as a wax filled cartridge) tend not to have any toggle action. Instead, after a few on-off cycles, the valves tend to just throttle the flow until the water reaches an equilibrium temperature, at which time the valve stays slightly cracked open. While this meets the primary function of keeping the water at a remote faucet hot, it constantly bleeds a small amount of hot or almost hot water into the cold water piping, thereby keeping the faucet end of the cold water pipe substantially warm. If truly cold water is desired (i.e., for brushing teeth, drinking, or making cold beverages), then some water must be wasted from the cold water faucet to drain out the warm water. If the bypass valve is equipped with a spring loaded check valve to prevent siphoning of cold water into the hot water side when only the hot water faucet is open, then the very small flow allowed through the throttled-down valve may cause chattering of the spring loaded check valve. The chattering can be avoided by using a free floating or non-spring loaded check valve. Substantially warmed water in the cold water piping system is also undesirable as it requires re-adjustment of shower or tap valves to maintain a constant mix temperature while the "tepid" water is exhausted from the cold water pipe and replaced with cold water. This detracts from the users expectation of thermal bypass valve performance. It is also detrimental to have any noticeable crossover flow (siphoning) from hot to cold or cold to hot with any combination of faucet positions, water temperatures, or pump operation.

SUMMARY OF THE INVENTION

The thermostatically controlled bypass valve and water circulating system of the present invention solves the problems identified above. That is to say, the present invention provides a thermostatically controlled bypass valve placed at or near a fixture to automatically bypass cold or tepid water away from the hot water side of the fixture until the temperature of the water reaches the desired level. A single small circulating pump can be placed between the water heater and the first branch in the hot water supply line which supplies a fixture having a bypass valve to pressurize the hot water piping system and facilitate bypassing of the cold or tepid water.

In the primary embodiment of the present invention, the bypass valve is a generally tubular valve body having a first end (hot water side), a second end (cold water side) and a separating wall located therebetween. Preferably, the valve body is manufactured from a plastic material that is suitable for injection molding. The first end of the valve body has a first inlet port and a first discharge port and the second end has a second inlet port and a second discharge port. The separating wall has a passage that interconnects the first end and the second end of the valve body to allow water to flow from the first end to the second end. A thermally sensitive actuating element is disposed in the interior of the valve body at its first end. The actuating element has an actuating body and a rod member, the rod member being configured to operatively extend from the actuating body to seal against the passage located in the separating wall to prevent water flow therethrough. A bias spring is located in the valve body between the separating wall and the actuating body to urge the rod member toward the actuating body so as to open the passage. A check valve is located in the valve body at its second end to prevent flow of water from the cold water side to the hot water side.

In the preferred embodiment, the first and second inlet ports are axially disposed on the valve body, the first and second discharge ports are radially disposed on the valve body and the actuating element is a wax-filled cartridge actuator. The valve body has a positioning shoulder in its first end such that the actuating element abuts against this shoulder. An over-travel spring is located in the first end of the valve body between a mechanism for retaining the spring and the actuating element so as to urge the actuating body against the positioning shoulder. Preferably, the mechanism is a screen that is securably held in place by a retaining pin disposed in a retaining pin hole located in the first discharge port. The screen can be configured to be cleaned by the movement of water from the first inlet port to the first discharge port. The threads on the first and second inlet ports and on the first and second discharge ports can have flats or slots thereon. The bypass valve can be configured to be integral with a fixture, such as a faucet, shower, bathtub, washing machine or dishwasher, for use in a water distribution system having a hot water heater.

The present invention also describes a water circulating system for distributing water to at least one fixture which is configured for utilizing hot and cold water. The fixture has a hot water inlet and a cold water inlet. The hot water heater supplies hot water to the fixture through the hot water piping system that interconnects the hot water heater with the hot water inlet at the fixture. The system also has a source of cold water, such as the city water supply or a local well, for supplying cold water to the fixture through the cold water piping system that interconnects the source of cold water with the cold water inlet at the fixture. The source of cold water also supplies water to the hot water heater for distribution through the hot water piping system. As such, when the bypass valve is bypassing water the hot and cold water circulating systems form a loop. A thermostatically controlled bypass valve at the fixture interconnects the hot water piping system to the hot water inlet and the cold water piping system to the cold water inlet. The bypass valve is configured to bypass water from the hot water piping system to the cold water piping system until the water in the hot water piping system rises to a preset temperature value. The bypass valve can comprise the elements and be configured as described above. A single, small pump can be used in the hot water piping system to pump water through the hot water piping system to the hot water inlet on the fixture. In the preferred embodiment, the single pump is a low flow and low head pump and a check valve is used to pass water around the pump when the flow rate in the hot water piping system exceeds the flow rate capacity of the pump. An orifice can be located in the discharge of the pump to achieve the desired steep flow-head curve from available stock pumps. A mechanism for cyclically operating the pump can be used to reduce electrical demand and wear and tear on the pump and bypass valve. In addition, a flow switch can be connected to the pump for detecting the flow rate of the water in the hot water piping system and for shutting off the pump when the flow in the hot water piping system exceeds the flow rate capacity of the bypass valve. As above, the bypass valve can be manufactured to be integral with the fixture.

Accordingly, the primary objective of the present invention is to provide a thermostatically controlled bypass valve that is suitable for bypassing water from a hot water piping system to a cold water piping system at a fixture until the temperature of the water in the hot water piping system rises to a preset level for use at the fixture.

It is also an important objective of the present invention to provide a thermostatically controlled bypass valve that has a generally tubular valve body with two inlet ports and two discharge ports to connect to a fixture that utilizes hot and cold water and to sources of hot and cold water.

It is also an important objective of the present invention to provide a thermostatically controlled bypass valve that utilizes a thermally sensitive actuating element having a rod member configured to open and close a passage between the hot and cold sides of the bypass valve based on the temperature of the water adjacent to the fixture.

It is also an important objective of the present invention to provide a thermostatically controlled bypass valve that has a check valve in the cold water side of the bypass valve to prevent the flow of water from the cold water piping system to the hot water piping system.

It is also an important objective of the present invention to provide a thermostatically controlled bypass valve that utilizes a pump in the hot water piping system to circulate water from the hot water piping system to the cold water piping system through the bypass valve until the temperature of the water in the hot water piping system reaches a preset level.

It is also an important objective of the present invention to provide a thermostatically controlled bypass valve that is suitable for integrally incorporating into a fixture that utilizes hot and cold water.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

Figure 1:
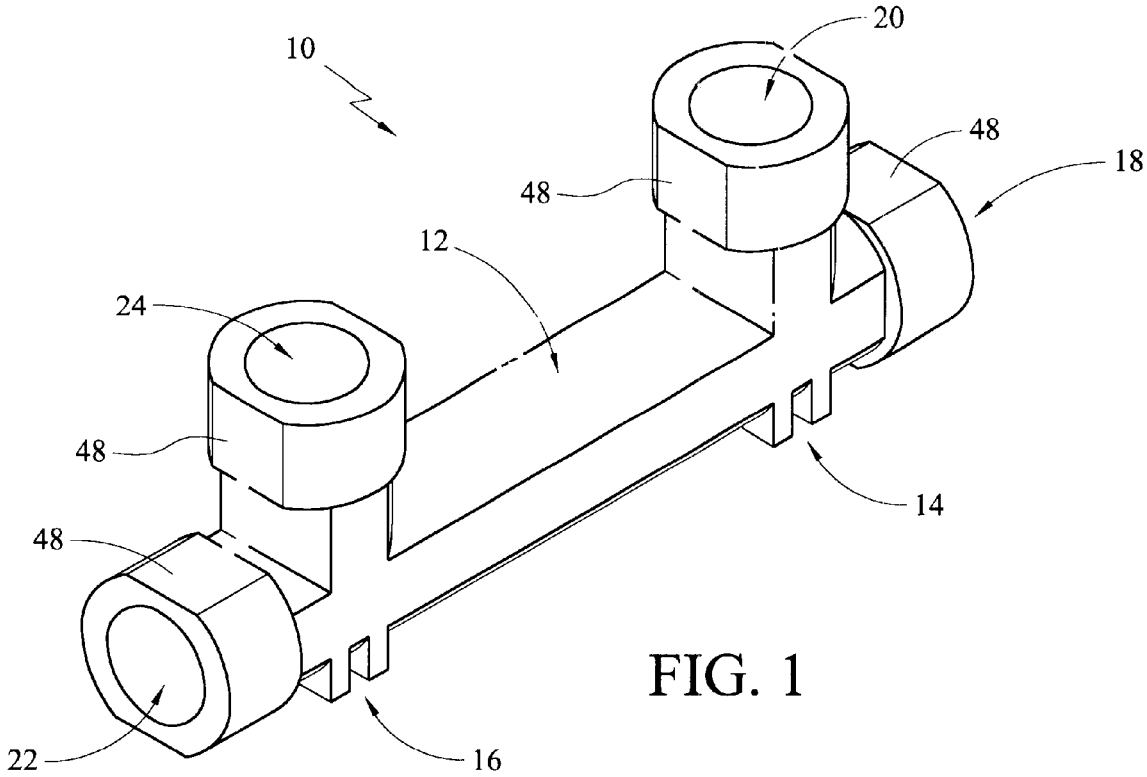
FIG. 1 is a perspective view of an assembled thermostatically controlled bypass valve utilizing the preferred embodiments of the present invention.
Figure 2:
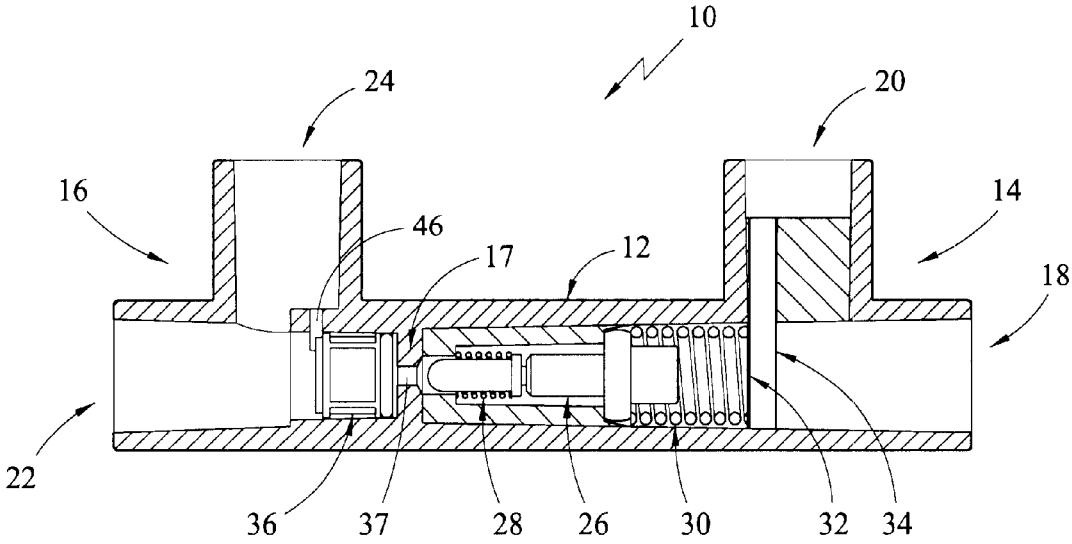
FIG. 2 is a cross-sectional side view of the bypass valve in FIG. 1.
Figure 3:
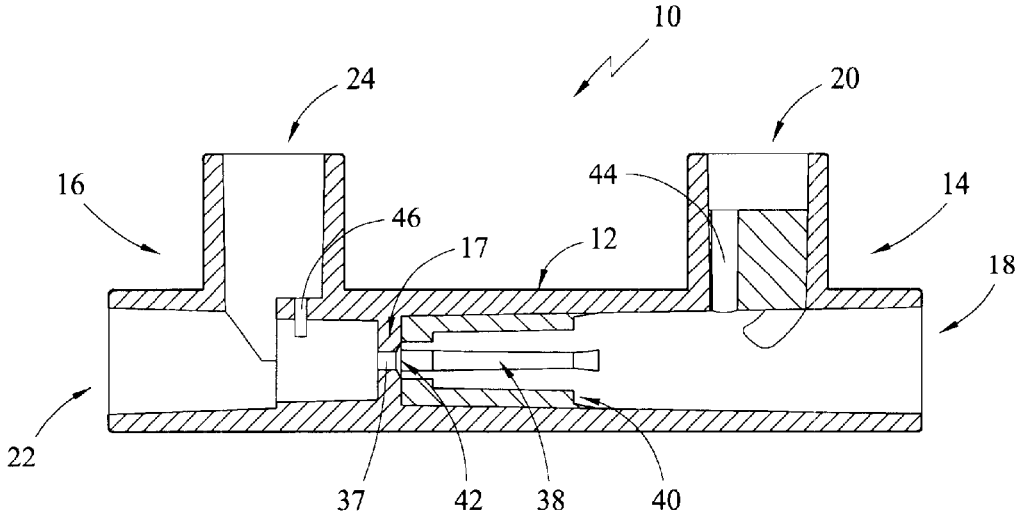
FIG. 3 is a cross-sectional side view of the valve body of the bypass valve of FIG. 1.
Figure 4:
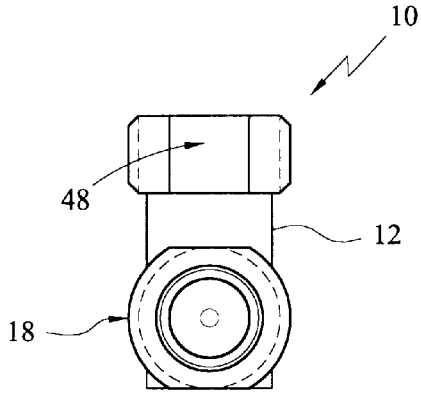
FIG. 4 is an end view of the second end of the valve body of the bypass valve of FIG. 1.
Figure 5:
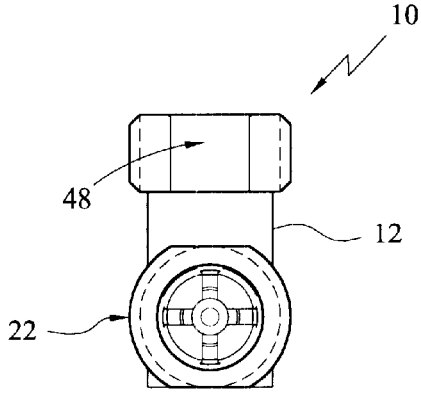
FIG. 5 is an end view of the first end of the valve body of the bypass valve of FIG. 1.

With reference to the figures where like elements have been given like numerical designations to facilitate the reader's understanding of the present invention, and particularly with reference to the embodiment of the present invention illustrated in FIGS. 1 through 7, the preferred embodiment of the thermostatically controlled bypass valve of the present invention is designated generally as 10. As best shown in FIGS. 1 through 3, bypass valve 10 comprises a generally tubular valve body 12 having a first end 14, a second end 16 and a separating wall 17 disposed between first end 14 and second end 16. First end 14 is designated to receive and discharge hot water and second end 16 is designated to receive and discharge cold water from a source of cold water, such as a city water supply system or a local water well. Tubular valve body 12 has four threaded ports, an axial and radial port at the first end 14 and an axial and radial port at the second end 16. For purposes of discussion herein, the axial ports are designated as inlet ports and the radial ports are designated as discharge ports, however, it will be understood from the discussion set forth below that the invention is not so limited.

At the first end 14 (the hot water side) is first inlet port 18 and first discharge port 20 and at the second end 16 (the cold water side) is second inlet port 22 and second discharge port 24. Conversely, the radial ports can be the inlet ports and the axial ports can be the discharge ports. As discussed in detail below, the first 1 8 and second 22 inlet ports connect to the hot and cold water distribution system and first 20 and second 24 discharge ports connect to the hot and cold water valves on the fixture (i.e., sink, shower, bathtub or etc.) with which the bypass valve 10 is utilized. The use of both an inlet 18 and discharge 20 ports on the hot side distinguish the present invention from other known bypass valves, which utilize a single port, and provide significant benefits for bypass valve 10. The bypass valve 10 of the present invention reduces the number of plumbing fittings (at least one tee) and plumber time for installation by allowing it to be connected simply with swivel nut hoses. Because the "tee" function is internal to valve body 12, hot water flowing to the open fixture valve flows through valve body 12, around the thermal actuator body, allowing immediate response to rising temperature. Conversely, if the tee is an external pipe fitting remote from the thermal bypass valve, response will be slowed. This use of an integral tee shortens time in which water can be siphoned from cold to hot, eliminating the need for an internal check valve. Hot water flowing through valve body 12 to an open fixture also allows placement of a screen inside the valve body 12 such that it is swept clean. The use of the second port on the hot side also allows placement of a retaining pin without the need for an extra seal. The use of two ports on the cold side (i.e., inlet port 22 and discharge port 24) also eliminates the use of an external tee and further simplifies and reduces the cost of installing the bypass valve 10. In addition, two ports on the cold side also facilitate the use of a retaining slot for holding a check valve, if one is used.

As best shown in FIG. 2 and discussed in more detail below, valve body 12 houses a thermally sensitive actuating element 26, bias spring 28, an over-travel spring 30, screen 32, retaining pin 34 and check valve 36. Valve body 12 can most economically and effectively be manufactured out of a molded plastic material, such as Ryton®, a polyphenylene sulphide resin available from Phillips Chemical, or a variety of composites. Molded plastic materials are preferred due to their relatively high strength and chemical/corrosion resistant characteristics while providing the ability to manufacture the valve body 12 utilizing injection molding processes with the design based on the configuration described herein without the need for expensive casting or machining. Alternatively, valve body 12 can be manufactured from various plastics, reinforced plastics or metals that are suitable for "soft" plumbing loads and resistant to hot chlorinated water under pressure. As shown in FIGS. 2 and 3, first end 14 of valve body 12 is molded with wall 17 having a passage 37 therein interconnecting first end 14 and second end 16 to allow fluid to flow therethrough, a set of axially oriented fin guides 38 having ends that form an internal shoulder 40 inside valve body 12 for fixedly receiving and positioning one end of thermal actuating element 26 and the bias spring 28, and a retaining pin hole 44 for receiving retaining pin 34. Second end 16 is molded with retaining slot 46 for engagement with the snap-in check valve 36. The valve body 12 is designed so the components can fit through either of the inlet and/or discharge ports, which will typically be one-half inch diameter. In this manner, a one piece bypass valve 10 results with no intermediate or additional joints required for installation.

For ease of installation of the bypass valve 10 by the user, each of the four ports (18, 20, 22 and 24) on valve body 12 have one-half inch straight pipe threads for use with the swivel nuts that are commonly found on standard connection hoses that fit the typical residential faucet. The threads on all four ports are molded with flats or axial slots 48 interrupting the threads to prevent a user from attempting to mount valve body 12 directly to "hard" plumbing with female taper pipe threads. The swivel nuts on the connection hoses seal with hose washers against the ends of the four ports, as opposed to common pipe fittings that seal at the tapered threads. These four ports can be marked "hot in", "hot out", "cold in", and "cold out" as appropriate to provide visual indicators for the do-it-yourself installer so as to avoid confusion. In the preferred installation of bypass valve 10, inlet port 18 connects to the hot water angle stop at the wall and the discharge port 20 connects to the hot water faucet. Inlet port 22 connects to the cold water angle stop and discharge port 24 connects to the cold water faucet. In actuality, the two hot hoses can be interchanged on the two hot ports (ports 18 and 20), as can the two cold hoses on the cold ports (ports 22 and 24).

Figure 6:
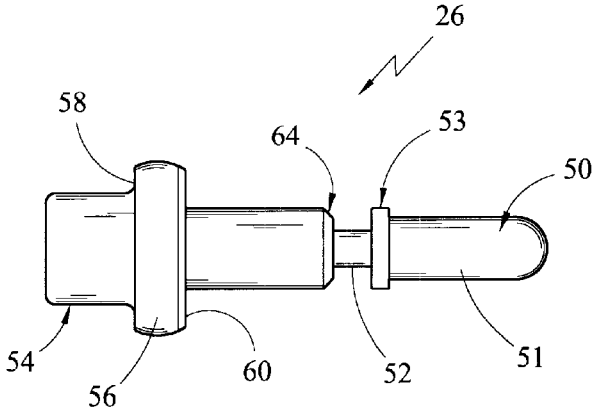
FIG. 6 is a side view of the preferred thermally sensitive actuating element for use in the bypass valve of the present invention.

Thermally sensitive actuating element 26 is preferably of the wax filled cartridge type, also referred to as wax motors, having an integral piston/poppet rod member 50, as best shown in FIG. 6. Rod member 50 comprises poppet 51 attached to piston 52 with an intermediate flange 53 thereon. The end of poppet 51 seats against valve seat 42 to close passage 37. These thermostatic control elements are well known in the art and are commercially available from several suppliers, such as Caltherm of Bloomfield Hills, Mich. The body 54 of actuating element 26 has a section 56 of increased diameter to seat against shoulder 40 in valve body 12. As shown in FIG. 2, over-travel spring 30 abuts against first side 58 of actuator body 54 and second side 60 of actuator body abuts against shoulder 40. Piston 52 of rod member 50 interconnects poppet 51 with actuator body 54. Actuating element 26 operates in a conventional and well known manner. Briefly, actuating element 26 comprises a wax or a mixture of wax and metal powder (i.e., copper powder) enclosed in actuator body 54 by means of a membrane made of elastomer or the like. Upon heating the wax or wax with copper powder mixture slowly expands, thereby pushing piston 52 and poppet 51 of rod member 50 in an outward direction. Upon cooling, the wax or wax/copper powder mixture contracts and rod member 50 is pushed inward by bias spring 28 until flange 53 contacts actuator body 54 at actuator seat 64. Although other types of thermal actuators, such as bimetallic springs and memory alloys (i.e., Nitinol and the like) can be utilized in the present invention, the wax filled cartridge type is preferred because the wax can be formulated to change from the solidus to the liquid state at a particular desired temperature. The rate of expansion with respect to temperature at this change of state is many times higher, resulting in almost snap action of the wax actuating element 26. The temperature set point is equal to the preset value, such as 97 degrees Fahrenheit, desired for the hot water. This is a "sudden" large physical motion over a small temperature change. As stated above, this movement is reacted by bias spring 28, which returns rod member 50 as the temperature falls.

Although not entirely demonstrated in early tests, it is believed that beneficial "toggle" action can be achieved with a bypass valve 10 of very simple mechanical design. If the motion of the thermal actuator 26 is made to lag behind the temperature change of the water surrounding it by placing suitable insulation around the actuator 26 or by partially isolating it from the water, then instead of slowly closing only to reach equilibrium at a low flow without reaching shutoff, the water temperature will rise above the extending temperature of the insulated actuator 26 as the valve approaches shutoff, and the piston 50 will then continue to extend as the internal temperature of the actuator 26 catches up to its higher surrounding temperature, closing the valve 10 completely. It is also believed that an insulated actuator 26 will be slow opening, its motion lagging behind the temperature of the surrounding cooling-off water from which it is insulated. When actuating element 26 finally begins to open the valve 10 and allow flow, the resulting rising temperature of the surrounding water will again, due to the insulation, not immediately affect it, allowing the bypass valve 10 to stay open longer for a complete cycle of temperature rise. Such an "insulated" effect may also be accomplished by use of a wax mix that is inherently slower, such as one with less powdered copper or other thermally conductive filler. An actuator 26 to be installed with insulation can be manufactured with a somewhat lower set point temperature to make up for the lag, allowing whatever valve 10 closing temperature desired.

Also inside valve body 12 is an over-travel spring 30, disposed between the first side 58 of the actuator body 54 and a stop located inside valve body 12 to prevent damage to a fully restrained actuator 26 heated above the bypass valve's 10 maximum operating temperature and to hold the actuator 26 in place during operation without concern for normal tolerance. Over-travel spring 30 allows movement of the actuator body 54 away from the seated poppet 51 in the event that temperature rises substantially after the poppet 51 contacts seat 42. Without this relief, the expanding wax would distort its copper can, destroying the calibrated set point. The over-travel spring 30 also holds the bias spring 28, rod member 50 and actuator body 54 in place without the need to adjust for the stack-up of axial tolerances. Alternatively, actuator 26 can be fixedly placed inside valve body 12 by various mechanisms known in the art, including adhesives and the like. Over-travel spring can be held in place by various internal configurations commonly known in the art, such as a molded seat. In the preferred embodiment, however, over-travel spring 30 abuts against screen 32, which is held in place by cantilevered retention pin 34. Screen 32 can be a small wire fabric, mesh-type screen that is shaped and configured to fit within the first end 14 of valve body 12. Screen 32 is utilized to keep hard water lime particles and other detritus out of bypass valve 10 and to act as a seat for the over-travel spring (as explained above). Screen 32 is positioned inside valve body 12, as shown in FIG. 2, at the intersection of first inlet port 18 and first discharge port 20 so as to have its surface swept clean each time the hot water faucet is turned on. The retention pin 34 is to hold screen 32, as well as the other components, in place inside valve body 12. Retention pin 34 is installed in valve body 12 through first discharge port 20 so as to abut screen 32, thereby eliminating the need for an extra external seal.

In an alternative embodiment of the present invention, a snap-in cartridge check valve 36 is located in the second end 16 of valve body 12, as shown in FIG. 2, to prevent siphoning of cold water through the bypass valve 10 when only the hot water faucet is on, and at a high flow rate, prior to the hot water temperature rising. The preferred embodiment does not use the check valve because at very low flow rates the check valve will tend to chatter, which is a common problem with check valves.

Figure 7:
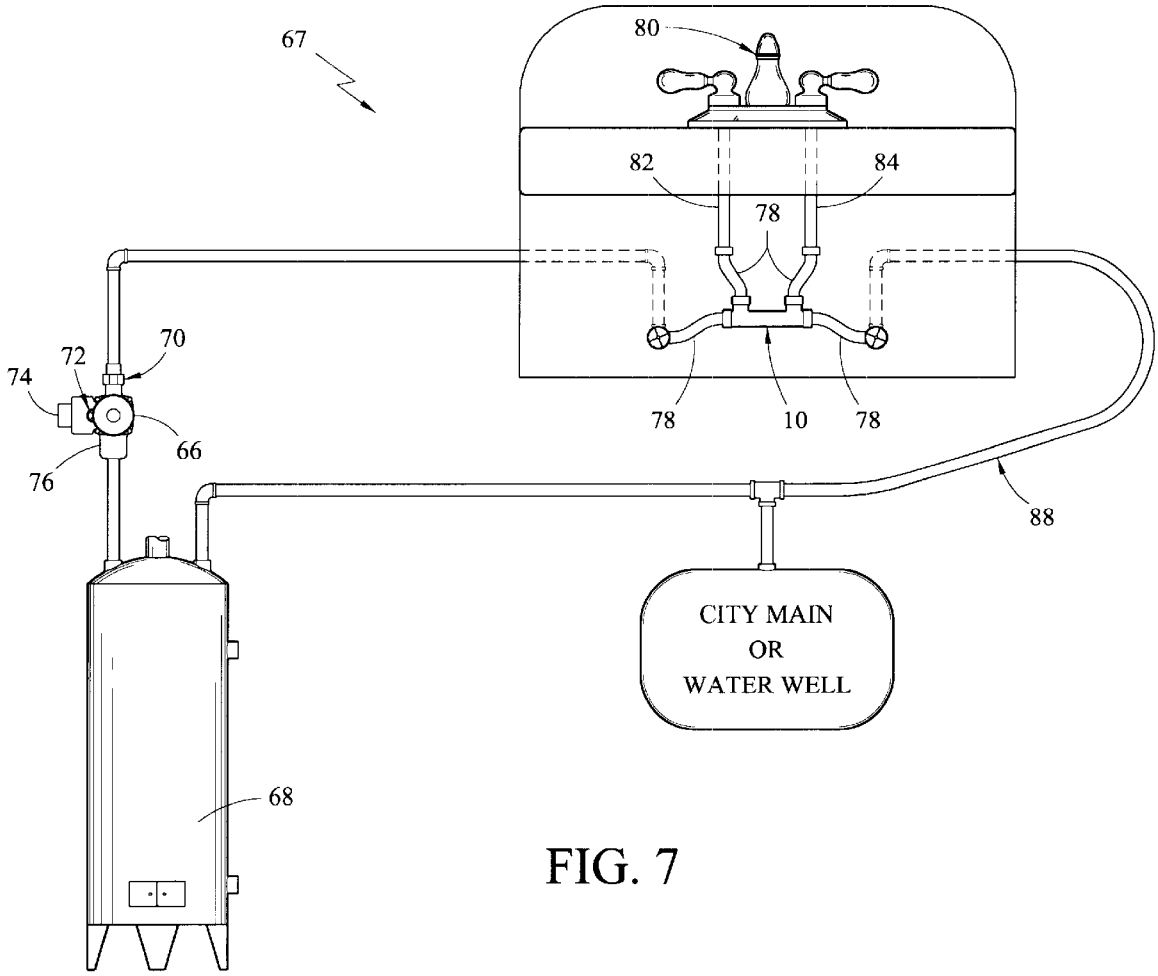
FIG. 7 is a side elevation view showing a water distribution system and fixture utilizing the bypass valve of the present invention.

In order to achieve the desired circulation flow, a single circulating pump 66 is utilized as part of a water circulating system 67, as shown in FIG. 7. Pump 66 can be a single, small pump of the type used in residential hot water space heating. In fact, a very low flow/low head pump is desirable, as a larger (i.e., higher head/higher flow) pump mounted at the typical domestic water heater 68 tends to be noisy. This annoying noise is often transmitted by the water pipes throughout the house. In addition, if the shower (as an example) is already in use when pump 66 turns on, whether the first start or a later cyclic turn-on, the sudden pressure boost in the hot water line from a larger pump can result in an uncomfortable and possibly near-scalding temperature rise in the water at the shower head or other fixture in use. The smaller boost of a "small" pump (i.e., one with a very steep flow-head curve) will result in only a very small and less noticeable increase in shower temperature. In the preferred embodiment, the single, small pump 66 needs to provide only a flow of approximately 0.3 gpm at 1.0 psi pressure. In accordance with pump affinity laws, such a "small" pump requires a very small impeller or low shaft speed. The inventors have found that use of a very small impeller or low shaft speed also precludes formation of an air bubble in the eye of the impeller, which bubble may be a major cause of noise. Such a small steep curve pump will, however, constitute a significant pressure drop in the hot water line when several fixture taps are opened simultaneously (such as a bathtub and the kitchen sink). To avoid reduced flow, a check valve 70 can be plumbed in parallel with pump 66 or incorporated within the pump housing, to pass a flow rate exceeding the pump's capacity around pump 66. When pump 66 is powered and flow demand is low, check valve 70 prevents the boosted flow from re-circulating back to its own inlet. With check valve 70 plumbed around pump 66, it is advantageous to place an orifice 72 in the pump discharge to provide a simple manner to achieve the desired very steep flow-head curve from available stock pump designs. A single pump 66 located at or near the water heater 68 in its discharge piping will boost the pressure in the hot water pipes somewhat above that in the cold water pipes (i.e., perhaps one to three feet of boost). With this arrangement only one pump 66 per plumbing system (i.e., per water heater) is required with any reasonable number of remote faucet sets (i.e., the typical number used in residences) equipped with bypass valves 10. This is in contrast to those systems that require multiple pumps, such as a pump at each fixture where bypassing is desired.

If desired, pump 66 can operate twenty-four hours a day, with most of the time in the no flow mode. However, this is unnecessary and wasteful of electricity. Alternatively, pump 66 can have a timer 74 to turn on the pump 66 daily at one or more times during the day just before those occasions when hot water is usually needed the most (for instance for morning showers, evening cooking, etc.) and be set to operate continuously for the period during which hot water is usually desired. This still could be unnecessary and wasteful of electricity. Another alternative is to have the timer 74 cycle pump 66 on and off regularly during the period when hot water is in most demand. The "on" cycles should be of sufficient duration to bring hot water to all remote fixtures that are equipped with a bypass valve 10, and the "off" period would be set to approximate the usual time it takes the water in the lines to cool-down to minimum acceptable temperature. Yet another alternative is to equip pump 66 with a normally closed flow switch 76 sized to detect significant flows only (i.e., those flows that are much larger than the bypass valve 10 flows), such as a shower flowing. For safety purposes, the use of such a switch 76 is basically required if a cyclic timer 74 is used. The switch can be wired in series with the pump motor. If the switch indicates an existing flow at the moment the timer calls for pump on, the open flow switch will prevent the motor from starting, thereby avoiding a sudden increase in water temperature at the fixture (i.e., a shower) being utilized. The use of such a switch accomplishes several useful objectives, including reducing electrical power usage and extending pump life if hot water is already flowing and there is no need for the pump to operate, avoiding a sudden temperature rise and the likelihood of scalding that could result from the pump boost if water is being drawn from a "mixing" valve (such as a shower or single handle faucet) and allowing use of a "large" pump (now that the danger of scalding is eliminated) with its desirable low pressure drop at high faucet flows, thereby eliminating the need for the parallel check valve 70 required with a "small" pump.

By using a time-of-day control timer 74, pump 66 operates to maintain "instant hot water" only during periods of the day when it is commonly desired. During the off-cycle times, the plumbing system operates just as if the bypass valves 10 and pump 66 were not in place. This saves electrical power usage from pump operation and, more importantly, avoids the periodic introduction of hot water into relatively uninsulated pipes during the off-hours, thereby saving the cost of repeatedly reheating this water. The time-of-day control also avoids considerable wear and tear on pump 66 and the bypass valves 10. Considerable additional benefits are gained by using a cyclic timer 74, with or without the time-of-day control. In addition to saving more electricity, if a leaky bypass valve or one not having toggle action is used, there will be no circulating leakage while the pump is cycled off, even if the valve fails to shut off completely. Therefore, a simple (i.e., one not necessarily leak tight) valve may suffice in less demanding applications. Having the leakage reduced to just intermittent leakage will result in reduced warming of the cold water line and less reheating of "leaking" recirculated water. In addition, shut-off of a toggle action valve upon attainment of the desired temperature is enhanced by the differential pressure an operating pump provides. If pump 66 continues to run as the water at the bypass valve 10 cools down, the pump-produced differential pressure works against re-opening the valve. If pump 66 operates cyclically, powered only a little longer than necessary to get hot water to bypass valve 10, it will be "off" before the valve 10 cools down. When the minimum temperature is reached, the thermal actuator 26 will retract, allowing the bias spring 28 to open the valve 10 without having to fight a pump-produced differential pressure. Bypass flow will begin with the next pump "on" cycle. An additional benefit to the use of either a time-of-day or cyclic timer 74 is that it improves the operating life of thermal actuator 26. Because use of either timer 74 causes cyclic temperature changes in valve 10 (as opposed to maintaining an equilibrium setting wherein temperature is constant and the actuator barely moves), there is frequent, substantial motion of the piston 50 in thermal actuator 26. This exercising of actuator 26 tends to prevent the build-up of hard water deposits and corrosion on the actuator piston 50 and poppet face, which deposits would render the valve 10 inoperable.

In the preferred embodiment, bypass valve 10 is manufactured from a one-piece molded valve body 12 that is configured as described above with fin guides 38, internal shoulder 40, passage 37, retaining pin hole 44 and retaining slot 46 for ease of manufacture and reduced manufacturing costs. The bias spring 28, wax cartridge actuating element 26 with its piston/poppet rod member 50, the over-travel spring 30 and screen 32 are placed into the "hot" axial port (the first inlet port 18) in that order. Screen 32 is pushed against the over-travel spring 30 compressing it, thereby making room for insertion of the retaining pin 34 through the retaining pin hole 44 at the "hot" radial port (the first discharge port 20). The cartridge check valve 36, if utilized, is inserted into the "cold" axial port (the second inlet port 22) and snaps into place in retaining slot 46.

Installation of the bypass valve 10 of the present invention is also made easy by manufacturing the valve 10 in the configuration as set forth above. As discussed, valve body 12 is molded with four ports (designated as 18, 20, 22 and 24).to allow installation with commonly used under-sink (as an example) vinyl hoses or flexible metal pipe, shown as 78 in FIG. 7, having swivel ends and faucet washers. The inlet ports 18 and 22 on valve body 12 are formed with one-half inch straight pipe threads to allow the installer to remove the end of the wall shut off-to-faucet hoses (hot and cold) at the faucet 80 and connect those ends, which are commonly one-half inch straight pipe threads, to valve inlets 18 and 22. The valve discharge ports 20 and 24 are likewise molded with one-half inch straight pipe threads to allow connection from them to the hot 82 and cold 84 inlets at faucet 80. The threads on all four ports will seal only with hose washers and swivel nuts. Because the use of a plastic valve body 12 is envisioned, the inability to mount valve body 12 directly to "hard" plumbing with taper pipe threads insures that the body 12 will be connected only with flexible lines 78, thereby precluding any plumbing loads that might overstress the non-metallic body. Because all current American faucets 80 are equipped with one-half inch straight pipe threads, the recommended procedure is to remove the pair of existing connection hoses 78 from the faucet 80 and connect these loose ends to the appropriate inlet ports 18 and 22 of valve body 12. The angle stop valves at the wall may have any of several possible thread size connections, or may have permanently connected hoses or tubes. As a result, it is best not to disturb these wall connections, but instead use hoses 78 to connect from the angle stop to bypass valve 10. A new set of hoses 78 with one-half inch straight pipe thread swivel nuts at both ends can then be connected from discharge ports 20 and 24 of valve body 12 to the appropriate hot 82 and cold 84 water connections on faucet 80.

Figure 8:
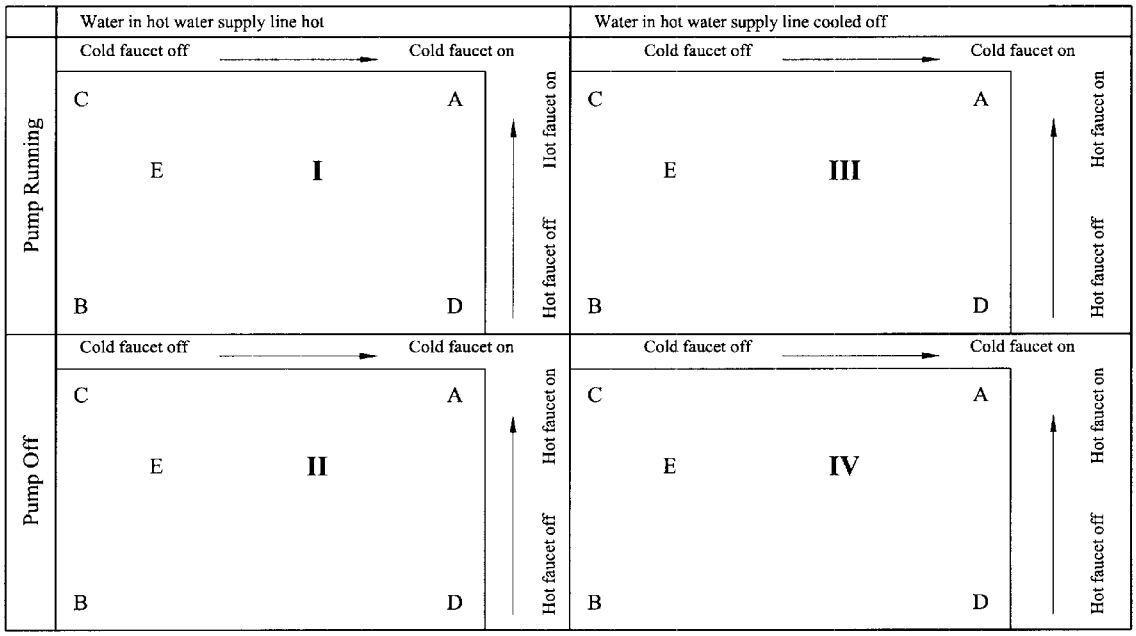
FIG. 8 is chart showing the operational characteristics of the bypass valve of the present invention when in use with a water distribution system.

The operation of the bypass valve 10 of the present invention is summarized on the chart shown as FIG. 8, which indicates the results of the twenty combinations of conditions (pump on/pump off; hot water line hot/hot water line cooled off; hot faucet on, or off, or between; cold faucet on or off, or between) that are applicable to the operation of valve 10. The operating modes IVB, IVC, IVD, IIIB, & IIID are summarized detailed in the immediately following text. The operation of the remaining fifteen modes are relatively more obvious, and may be understood from the abbreviated indications in the outline summarizing FIG. 8. Starting with the set "off" hours (normal sleeping time, and daytime when no one is usually at home) pump 66 will not be powered. Everything will be just as if there were no pump 66 and no bypass valve 10 installed (i.e., both the cold and hot water lines will be at the same (city water) pressure). The hot water line and bypass valve 10 will have cooled off during the long interim since the last use of hot water. The reduced temperature in the valve results in "retraction" of rod member 50 of the thermally sensitive actuator 26. The force of bias spring 28 pushing against flange 53 on rod member 50 will push it back away from valve seat 42, opening valve 10 for recirculation. Although the thermal actuating element 26 is open, with pump 66 not running, no circulation flow results, as the hot 86 and cold-88 water piping systems are at the same pressure. This is the mode indicated as IVB in the outline on FIG. 8. If the cold water valve at faucet 80 is opened with the thermal element 26 open as in mode IVB above, pressure in the line 88 to the cold water side of faucet 80 will drop below the pressure in the hot water line 86. This differential pressure will siphon tepid water away from the hot side to the cold side, which is the mode indicated as IVD in the outline on FIG. 8. The recirculation will end when the tepid water is exhausted from the hot water line 86 and the rising temperature of the incoming "hot" water causes the thermal element 26 to close.

If the hot water valve is turned on with the thermal element 26 open as in mode IVB above, pressure in the line 86 to the hot water side of faucet 80 will drop below the pressure in the cold water line 88. This differential pressure, higher on the cold side, will load check valve 36 in the "closed" direction allowing no cross flow. This is mode IVC in the outline on FIG. 8. In this mode, with the hot water line 86 cooled and the pump off, a good deal of cooled-off water will have to be run oust as if valve 10 were not installed), to get hot water, at which time the thermal element 26 will close without effect, and without notice by the user. With the thermal element 26 open and the hot water line 86 cooled-off as in mode IVB above, at the preset time of day (or when the cyclic timer trips the next "on" cycle) the pump 66 turns on, pressurizing the water in the hot side of valve 10. Pump pressure on the hot side of valve 10 results in flow through the open thermal element 26, thereby pressurizing and deflecting the check valve 36 poppet away from its seat to an open position. Cooled-off water at the boosted pressure will thus circulate from the hot line 86 through the thermal element 26 and check valve 36 to the lower pressure cold line 88 and back to water heater 68. This is the primary "working mode" of the bypass valve 10 and is the mode indicated as IIIb in the outline on FIG. 8. If the cold water valve is turned on during the conditions indicated in mode IIIB above (i.e., pump 66 operating, hot line 86 cooled off, both the hot and cold valves at faucet 80 off) and while the desired recirculation is occurring, mode IIID will occur. A pressure drop in the cold water line 88 due to cold water flow creates a pressure differential across valve 10 in addition to the differential created by pump 66. This allows tepid water to more rapidly bypass to the cold water inlet 84 at faucet 80. When the tepid water is exhausted from the hot water line 86, thermal element 26 will close, ending recirculation.

Explanation of FIG. 8 Table

MODE I: Water In Hot Water Supply Line Hot, Pump On

A. Hot and cold faucet valves full open Pressure drops from hot and cold flow about equal. Actuator element 26 stays closed. No leak or recirculation in either direction.

B. Hot and cold faucet valves fully closed Thermal actuator 26 keeps valve 10 closed. No recirculation.

C. Hot faucet valve fully open, cold faucet valve closed Actuator element 26 closed. Check valve 36 closed. No recirculation. No leak.

D. Hot faucet valve closed, cold faucet valve fully open Actuator element 26 closed. No recirculation. No leak.

E. Hot and cold faucet valves both partially open in any combination Actuator element 26 closed. No recirculation. No leak.

MODE II: Water in Hot Water Supply Line Hot, Pump Off

A. Hot and cold faucet valves full on Pressure drops from hot and cold flow about equal. Actuator element 26 stays closed.

B. Hot and cold faucet valves fully closed Thermal actuator 26 keeps valve 10 closed. No recirculation.

C. Hot faucet valve fully open, cold faucet valve closed Thermal actuator 26 closed. Check valve 36 closed. No recirculation. No leak.

D. Hot faucet closed, cold faucet fully open Thermal actuator 26 closed. No recirculation. No leak.

E. Hot and cold faucets both partially open in any combo Thermal actuator 26 closed. No recirculation. No leak.

MODE III: Water in Hot Water Line Cooled Off, Pump On

A. Hot and cold faucet valves full open Flow-induced pressure drops about equal, valve 10 stays open and allows recirculation hot to cold until tepid water is exhausted and hotter water closes thermal actuator 26. If both faucet valves are at same sink, they are mixing hot and cold anyway. If faucet valves being manipulated are at remote sinks on the same plumbing branch, this short time tepid-to-cold leak will probably not be noticeable. If faucet valves being manipulated are on remote branches of plumbing, the mixing would have no effect.

B. Hot and cold faucet valves fully closed Thermal actuator 26 open, get desired tepid-to-cold recirculation until hot line heats up.

C. Hot faucet valve fully open, cold faucet valve closed Thermal actuator 26 open but pressure drop in hot line may negate pump pressure, stopping recirculation. Check valve 36 stops cold to hot leak.

D. Hot faucet valve closed, cold faucet valve fully open Thermal actuator 26 open, get tepid to cold recirculation until hot line heats up.

E. Hot and cold faucets both partially open in any combination Could get tepid to cold leak. If faucet valves at same sink don't care as mixing hot and cold anyway. If at remote sinks probably not noticeable. Tepid to cold leak would be short term.

MODE IV: Water In Hot Water Supply Line Cooled Off, Pump Off

A. Hot and cold faucet valves full open Flow-induced pressure drops about equal, valve 10 stays open and may allow recirculation (leak) hot to cold until tepid water is exhausted and hotter water closes thermal actuator 26. Don't care, if both faucets are at same sink as are mixing hot and cold anyway. If faucet valves being manipulated are at remote sinks on the same plumbing branch, this short time tepid-to-cold leak would probably not be noticeable. If faucets being manipulated are on remote branches of plumbing, mixing would not be noticeable.

B. Hot and cold faucet valves fully closed Thermal actuator 26 open, no recirculation.

C. Hot faucet valve fully open, cold faucet valve fully closed Thermal actuator 26 open. Check valve 36 closed. No leak D. Hot faucet valve closed. Cold faucet valve fully open Valve 10 open, tepid to cold recirculation until thermal actuator 26 heats up and closes.

E. Hot and cold faucet valves both partially open, in any combo Could get tepid to cold leak. If faucet valves at same sink, don't care as mixing hot and cold anyway. If at remote sinks probably not noticeable. Tepid to cold leak would be short term.

In an alternative embodiment of the present invention, the bypass valve 10 is incorporated into a fixture, such as faucet, shower or bathtub (as well as washing machines and dishwashers) for use in a water circulating system 67. In the alternative embodiment, the fixture would utilize the same internal components described above with the same schematic connections to the hot and cold inlet and discharge ports. The valve components may be installed into a housing integral with (or contained in a bezel covering) a valve for a sink, shower, bathtub or appliance. Utilization of the alternative embodiment would reduce installation costs by eliminating the extra set of hoses, thereby also eliminating four additional potential leak sources (i.e., the two ends of each of the two eliminated hoses).

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use.

What is claimed is:

1. A thermostatically controlled bypass valve, comprising:

a generally tubular valve body having a first end, a second end and a separating wall therebetween, said first end having a first inlet port and a first discharge port, said second end having at least one port, said separating wall having a passage therein interconnecting said first end and said second end of said valve body;

a thermally sensitive actuating element disposed in said valve body at said first end of said valve body, said actuating element having an actuating body and a rod member, said rod member configured to operatively extend from said actuating body and sealably abut said passage in said separating wall; and a bias spring disposed in said valve body between said separating wall and said actuating body of said actuating element and operative to urge said rod member toward said actuating body to open said passage in said separating wall.

2. The thermostatically controlled bypass valve according to claim 1, wherein said second end has a second inlet port and a second discharge port.

3. The thermostatically controlled bypass valve according to claim 2, wherein said first and second inlet ports are axially disposed on said valve body and said first and second discharge ports are radially disposed on said valve body.

4. The thermostatically controlled bypass valve according to claim 1 further comprising a check valve disposed in said valve body at said second end of said valve body.

5. The thermostatically controlled bypass valve according to claim 1, wherein said valve body is made out of a plastic material.

6. The thermostatically controlled bypass valve according to claim 1 further comprising an internal shoulder in said first end of said valve body, said actuating element disposed against said internal shoulder.

7. The thermostatically controlled bypass valve according to claim 6 further comprising spring retaining means disposed in said valve body at said first discharge port and an over-travel spring disposed between said spring retaining means and said actuating element, said over-travel spring urging said actuating body against said internal shoulder.

8. The thermostatically controlled bypass valve according to claim 7, wherein said spring retaining means comprises a screen securely held in place by a retaining pin disposed in a retaining pin hole in said first discharge port.

9. The thermostatically controlled bypass valve according to claim 1, wherein said actuating element is a wax-filled cartridge actuator.

10. The thermostatically controlled bypass valve according to claim 9, wherein the action of said actuating element is slowed by the use of insulation on said actuating element or the a reduction in the amount of conductive material in said wax-filled cartridge actuator to make said actuating element thermally less conductive.

11. The thermostatically controlled bypass valve according to claim 1 further comprising a screen disposed in said valve body at said first end of said valve body.

12. The thermostatically controlled bypass valve according to claim 11, wherein said screen is positioned in said first end of said valve body so as to be cleaned by the movement of water from said first inlet port to said first discharge port.

13. The thermostatically controlled bypass valve according to claim 1, wherein said rod member has a flange thereon, said flange configured to abut said bias spring.

14. The thermostatically controlled bypass valve according to claim 1, wherein each of said first inlet port, said first discharge port and said at least one port at said second end have flats or slots thereon.

15. The thermostatically controlled bypass valve according to claim 1, wherein said first discharge port is configured to have a retaining pin hole for receiving a retaining pin therein.

16. The thermostatically controlled bypass valve according to claim 1, wherein said bypass valve is configured to be integral with a fixture for use in a water distribution system having a hot water heater.

17. A thermostatically controlled bypass valve, comprising:

a generally tubular valve body having a first end, a second end and a separating wall therebetween, said first end having a first inlet port and a first discharge port, said second end having a second inlet port and a second discharge port, said separating wall having a passage therein interconnecting said first end and said second end of said tubular valve body;

a thermally sensitive actuating element disposed in said valve body, said actuating element having an actuating body and a rod member, said rod member configured to operatively extend from said actuating body and sealably abut said passage in said separating wall;

a bias spring disposed in said valve body between said separating wall and said actuating body of said actuating element and operative to urge said rod member toward said actuating body to open said passage in said separating wall;

spring retaining means disposed in said valve body at said first end of said tubular valve body; and an over-travel spring disposed between said spring retaining means and said actuating element, said over-travel spring urging said actuating body against said internal shoulder.

18. The thermostatically controlled bypass valve according to claim 17, wherein said actuating element is a wax-filled cartridge actuator.

19. The thermostatically controlled bypass valve according to claim 18, wherein the action of said actuating element is slowed by the use of insulation on said actuating element or the a reduction in the amount of conductive material in said wax-filled cartridge actuator to make said actuating element thermally less conductive.

20. The thermostatically controlled bypass valve according to claim 17 further comprising a check valve disposed in said valve body at said second end of said valve body.

21. The thermostatically controlled bypass valve according to claim 17, wherein said first and second inlet ports are axially disposed on said valve body and said first and second discharge ports are radially disposed on said valve body.

22. The thermostatically controlled bypass valve according to claim 17 further comprising an internal shoulder in said first end of said valve body, said actuating element disposed against said internal shoulder.

23. The thermostatically controlled bypass valve according to claim 17, wherein said spring retaining means comprises a screen securely held in place by a retaining pin disposed in a retaining pin hole in said first discharge port.

24. The thermostatically controlled bypass valve according to claim 17 further comprising a screen disposed in said valve body at said first end of said valve body.

25. The thermostatically controlled bypass valve according to claim 17, wherein said first discharge port is configured to have a retaining pin hole for receiving a retaining pin therein, said retaining pin configured to securely hold a screen in place.

26. The thermostatically controlled bypass valve according to claim 17, wherein said bypass valve is configured to be integral with a fixture for use in a water distribution system having a hot water heater.

27. A water circulating system for distributing water, comprising:

a fixture configured for utilizing hot and cold water, said fixture having a hot water inlet and a cold water inlet;

a hot water heater for supplying hot water to said fixture;

a hot water piping system interconnecting said hot water heater with said hot water inlet at said fixture;

a source of cold water for supplying cold water to said fixture and said hot water heater;

a cold water piping system interconnecting said source of cold water with said cold water inlet at said fixture; and a thermostatically controlled bypass valve at said fixture, said bypass valve interconnecting said hot water piping system and said hot water inlet and interconnecting said cold water piping system and said cold water inlet, said bypass valve configured to bypass water from said hot water piping system to said cold water piping system until the water in said hot water piping system reaches a preset temperature value, said bypass valve comprising a generally tubular valve body having a thermally sensitive actuating element and a bias spring disposed therein, said valve body having a first end, a second end and a separating wall therebetween, said first end having a first inlet port and a first discharge port, said second end having at least one port, said separating wall having a passage therein interconnecting said first end and said second end of said valve body, said actuating element disposed in said valve body at said first end of said valve body, said actuating element having an actuating body and a rod member, said rod member configured to operatively extend from said actuating body and sealably abut said passage in said separating wall, said bias spring disposed in said valve body between said separating wall and said actuating body of said actuating element and operative to urge said piston toward said actuating body to open said passage in said separating wall.

28. The water circulating system according to claim 27, wherein said second end of said tubular body has a second inlet port and a second discharge port.

29. The water circulating system according to claim 27 further comprising a check valve disposed in said valve body at said second end of said valve body to prevent the flow of water from said cold water piping system to said hot water piping system through said bypass valve.

30. The water circulating system according to claim 27 further comprising a pump in said hot water piping system, said pump configured to pump water through said hot water piping system to said hot water inlet on said fixture.

31. The water circulating system according to claim 30, wherein said water circulating system utilizes a single pump in said hot water piping system prior to the first branch of said hot water piping system leading to said fixture having said bypass valve.

32. The water circulating system according to claim 30, wherein said pump is a low flow and low head pump.

33. The water circulating system according to claim 32 further comprising a pump check valve configured to pass water around said pump when the flow rate in said hot water piping system exceeds the flow rate capacity of said pump.

34. The water circulating system according to claim 32 further comprising an orifice in the discharge of said pump.

35. The water circulating system according to claim 30 further comprising means for cyclically operating said pump.

36. The water circulating system according to claim 35 further comprising a flow switch for detecting the flow of water in said hot water piping system, said flow switch operatively connected to said pump and suitable for shutting off said pump when the flow of water in said hot water piping system exceeds the flow rate capacity of said bypass valve.

37. The water circulating system according to claim 27, wherein said bypass valve is integral with said fixture.

38. A water circulating system for distributing water, comprising:

a fixture configured for utilizing hot and cold water, said fixture having a hot water inlet and a cold water inlet;

a hot water heater for supplying hot water to said fixture;

a hot water piping system interconnecting said hot water heater with said hot water inlet at said fixture;

a source of cold water for supplying cold water to said fixture and said hot water heater;

a cold water piping system interconnecting said source of cold water with said cold water inlet at said fixture;

a thermostatically controlled bypass valve at said fixture, said bypass valve comprising a generally tubular valve body having a first end, a second end and a separating wall therebetween, said first end having a first inlet port and a first discharge port, said second end having at least one port, said bypass valve interconnecting said hot water piping system and said hot water inlet and interconnecting said cold water piping system and said cold water inlet, said bypass valve configured to bypass water from said hot water piping system to said cold water piping system until the water in said hot water piping system reaches a preset temperature value; and a single pump in said hot water piping system prior to the first branch of said hot water piping system leading to said fixture having said bypass valve, said pump configured to pump water through said hot water piping system to said hot water inlet on said fixture.

39. The water circulating system according to claim 38, wherein said bypass valve comprises a thermally sensitive actuating element and a bias spring disposed in said valve body, said separating wall having a passage therein interconnecting said first end and said second end of said valve body, said actuating element disposed in said valve body at said first end of said valve body, said actuating element having an actuating body and a rod member, said rod member configured to operatively extend from said actuating body and sealably abut said passage in said separating wall, said bias spring disposed in said valve body between said separating wall and said actuating body of said actuating element and operative to urge said piston toward said actuating body to open said passage in said separating wall.

40. The water circulating system according to claim 39, wherein said second end of said tubular body has a second inlet port and a second discharge port.

41. The water circulating system according to claim 39 further comprising a check valve disposed in said valve body at said second end of said valve body to prevent the flow of water from said cold water piping system to said hot water piping system through said bypass valve.

42. The water circulating system according to claim 38 wherein said water circulating system utilizes a single pump in said hot water piping system.

43. The water circulating system according to claim 38, wherein said pump is a low flow and low head pump.

44. The water circulating system according to claim 43 further comprising a pump check valve configured to pass water around said pump when the flow rate in said hot water piping system exceeds the flow rate capacity of said pump.

45. The water circulating system according to claim 43 further comprising an orifice in the discharge of said pump.

46. The water circulating system according to claim 38 further comprising means for cyclically operating said pump.

47. The water circulating system according to claim 46 further comprising a flow switch for detecting the flow of water in said hot water piping system, said flow switch operatively connected to said pump and suitable for shutting off said pump when the flow of water in said hot water piping system exceeds the flow rate capacity of said bypass valve.

48. The water circulating system according to claim 38, wherein said bypass valve is integral with said fixture.

* * * * *